US009463133B2

(12) United States Patent
Rodgers

(10) Patent No.: US 9,463,133 B2
(45) Date of Patent: Oct. 11, 2016

(54) DEEP TISSUE MASSAGE ROLLER

(71) Applicant: Maverick Sports Medicine, Inc., Redmond, WA (US)

(72) Inventor: Jeffrey Read Rodgers, Bellevue, WA (US)

(73) Assignee: MAVERICK SPORTS MEDICINE, INC., Redmond, WA (US)

( * ) Notice: Subject to any disclaimer, the term of this patent is extended or adjusted under 35 U.S.C. 154(b) by 659 days.

(21) Appl. No.: 13/804,549

(22) Filed: Mar. 14, 2013

(65) Prior Publication Data

US 2013/0261517 A1 Oct. 3, 2013

Related U.S. Application Data

(60) Provisional application No. 61/619,171, filed on Apr. 2, 2012.

(51) Int. Cl.
*A61H 7/00* (2006.01)
*A61H 15/00* (2006.01)

(52) U.S. Cl.
CPC ..... *A61H 7/00* (2013.01); *A61H 7/005* (2013.01); *A61H 7/007* (2013.01); *A61H 15/00* (2013.01); *A61H 15/0092* (2013.01); *A61H 7/002* (2013.01); *A61H 2015/0014* (2013.01); *A61H 2201/0153* (2013.01); *A61H 2201/0157* (2013.01); *A61H 2201/1253* (2013.01); *A61H 2201/1261* (2013.01); *A61H 2201/1276* (2013.01); *A61H 2201/1284* (2013.01); *A61H 2201/16* (2013.01); *A61H 2201/1683* (2013.01); *A61H 2205/081* (2013.01); *A61H 2205/10* (2013.01)

(58) Field of Classification Search
CPC ..... A61H 15/00; A61H 2015/0007; A61H 2015/0014; A61H 2015/0021; A61H 2015/0028; A61H 2015/0035; A61H 2015/0042; A61H 2015/005; A61H 2015/0057; A61H 2015/0064; A61H 2015/0071; A61H 15/0078; A61H 15/0085; A61H 15/0092; A61H 15/02; A61H 2201/0153; A61H 2201/0157
USPC ..... D24/211–215
See application file for complete search history.

(56) References Cited

U.S. PATENT DOCUMENTS 2,014,293 A 9/1935 Riley
2,080,208 A * 5/1937 Illch ..... A61H 15/00 601/121

(Continued)

*Primary Examiner* — Justine Yu
*Assistant Examiner* — Tu Vo
(74) *Attorney, Agent, or Firm* — Seed IP Law Group PLLC

(57) ABSTRACT

A deep tissue massage device that includes a compliant cylinder formed of compressible material, the cylinder having an external surface with at least one external ridge pattern formed on the exterior surface of the cylinder. The at least one ridge pattern includes a single ridge circumferentially formed on the exterior surface of the cylinder that has a V-shaped branch portion that extends from one end of the single ridge and joins together at a second end of the single ridge to form two opposing Y-shaped ridges.

15 Claims, 4 Drawing Sheets

(56) References Cited

U.S. PATENT DOCUMENTS 2,446,099 A * 7/1948 Niblack ..... A61H 15/0078 601/127
2,448,797 A * 9/1948 Gustlin ..... A61H 15/00 482/79
2,577,129 A 12/1951 Johnston et al.
2,628,611 A * 2/1953 Wagner ..... A61H 7/003 15/110
3,662,748 A * 5/1972 Thurman ..... A61H 15/00 601/121
3,847,144 A 11/1974 Wright
4,002,163 A 1/1977 Jackson, Jr.
4,067,324 A * 1/1978 Greenawalt ..... A61H 15/0092 601/120
D256,841 S * 9/1980 Corbett ..... D24/211
4,416,166 A 11/1983 Jannard et al.
4,513,738 A 4/1985 Niessen
D285,117 S * 8/1986 Snyder ..... D24/211
4,648,387 A 3/1987 Simmons
4,945,900 A 8/1990 Masuda
D361,132 S * 8/1995 Lee ..... D24/200
5,577,995 A 11/1996 Walker et al.
5,709,705 A 1/1998 Belcher
D417,319 S * 11/1999 Weiss, Jr. ..... D30/119
6,135,972 A 10/2000 Kuo
6,398,694 B1 * 6/2002 Bountourakis .. A63B 21/00069 482/109
6,419,650 B1 7/2002 Ryan et al.
6,764,456 B1 7/2004 Doherty
D558,887 S * 1/2008 Nan ..... D24/105
D660,450 S * 5/2012 Johnson ..... D24/215
2005/0215928 A1 * 9/2005 Banks ..... A61H 15/0092 601/112
2006/0142677 A1 6/2006 Perez
2006/0149174 A1 * 7/2006 Fink ..... A61H 1/0292 601/121
2008/0255484 A1 * 10/2008 Gueret ..... A45D 34/041 601/129
2009/0112137 A1 * 4/2009 Lamore ..... A61H 15/00 601/112
2010/0049106 A1 * 2/2010 Gueret ..... A45D 34/041 601/112
2012/0035029 A1 * 2/2012 Dye ..... A61H 15/0092 482/132
2012/0065557 A1 * 3/2012 Phillips ..... A61H 15/0092 601/99
2013/0096472 A1 * 4/2013 Bertram ..... A61H 15/0092 601/120

* cited by examiner

DEEP TISSUE MASSAGE ROLLER

CROSS-REFERENCE TO RELATED APPLICATION

This application claims the benefit of U.S. Patent Application.No.61/619,171, filed Apr.2, 2012.

BACKGROUND

1. Technical Field

The present disclosure is directed to non-invasive therapeutic devices for use on muscles, ligaments, and tendons and, more particularly, to a compliant cylindrical roller having deep tissue massage elements formed on an outer surface for selective application by a user.

2. Description of the Related Art

Massaging of muscles, tendons, and ligaments is known to provide therapeutic benefits in overcoming injuries to soft tissues, as well as addressing muscle tightness, lack of flexibility, soft tissue adhesions, knots, and scar tissues. The use of manual massage is also known to maintain good health of these tissues. Countless tools and massage aids have been developed to provide a mechanical advantage and to relieve stress on the hands of the massage provider.

Recently, large scale devices have been utilized, such as a large tube or a ball, in which the weight of the body is applied to the device. By positioning the body in various orientations with respect to the tube or the ball and rolling the body across the device such that the device rolls on a supporting surface, provides the application of greater force to the affected tissue. For example, one known device is nothing more than a tubular roller formed of foam material on which a user balances their body, typically in a reclining position, either on their back, side, or stomach. The roller has a smooth outer surface and is not supported on the ends. Some of these devices have textured surfaces to improve the effect of compressing soft tissue beneath the skin. One such device known as the RumblerRoller® manufactured and distributed by STI in Baton Rouge, La., incorporates bumps that have a firm yet flexible construction for continuously kneading the body. The closely spaced bumps (less than two inches apart) are designed to reduce area contact with the device while increasing pressure to provide a deeper, more penetrating action. The disadvantage of this design is that users cannot selectively position any one of the bumps over a desired area while not having bumps applied anywhere else on the body. Thus, there is a need for a roller massage device that provides for deep tissue massaging in selectable areas of the body without having surrounding tissue so deeply massaged.

BRIEF SUMMARY

The present disclosure is directed to a deep tissue massage device that includes a compliant cylinder formed of compressible material, the cylinder having an external surface with at least one external ridge formed on the exterior surface of the cylinder. The at least one ridge includes a single stem formed on the exterior surface of the cylinder that has a branch portion extending from one end of the stem, the branch portion having two legs.

In accordance with another aspect of the present disclosure, the two legs of the branch portion join back together at a second end of the stem.

In accordance with another aspect of the present disclosure, the two legs form a Y-shaped pattern.

In accordance with another aspect of the present disclosure, the at least one ridge is formed of either a continuous ridge or it is formed of ridge segments In accordance with another aspect of the present disclosure, the at least one ridge extends 360° circumferentially around the exterior surface of the device.

In accordance with another aspect of the present disclosure, the at least one ridge includes a pair of two opposing Y-shaped ridges placed side-by-side on the exterior surface of the device. Ideally, the pair of opposing Y-shaped ridges are in spaced parallel relationship on the exterior surface of the device.

In accordance with yet a further aspect of the present disclosure, a pair of end ridges or end caps are formed on each end of the cylinder, the end ridges extending from the exterior surface a distance that is equal to a distance that the at least one ridge extends from the exterior surface of the cylinder.

BRIEF DESCRIPTION OF THE SEVERAL VIEWS OF THE DRAWINGS

The foregoing and other features and advantages of the present disclosure will be more readily appreciated as the same become better understood from the following detailed description when taken in conjunction with the accompanying drawings, wherein.

DETAILED DESCRIPTION

In the following description, certain specific details are set forth in order to provide a thorough understanding of various disclosed embodiments. However, one skilled in the relevant art will recognize that embodiments may be practiced without one or more of these specific details, or with other methods, components, materials, etc. In other instances, well-known structures associated with foam rollers have not been shown or described in detail to avoid unnecessarily obscuring descriptions of the embodiments.

Unless the context requires otherwise, throughout the specification and claims which follow, the word "comprise" and variations thereof, such as, "comprises" and "comprising" are to be construed in an open, inclusive sense, that is as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and "the" include plural referents unless the content clearly dictates otherwise. It should also be noted that the term "or" is generally employed in its broadest sense, that is as meaning "and/or" unless the content clearly dictates otherwise.

The headings and Abstract of the Disclosure provided herein are for convenience only and do not interpret the scope or meaning of the embodiments.

Figure 1:
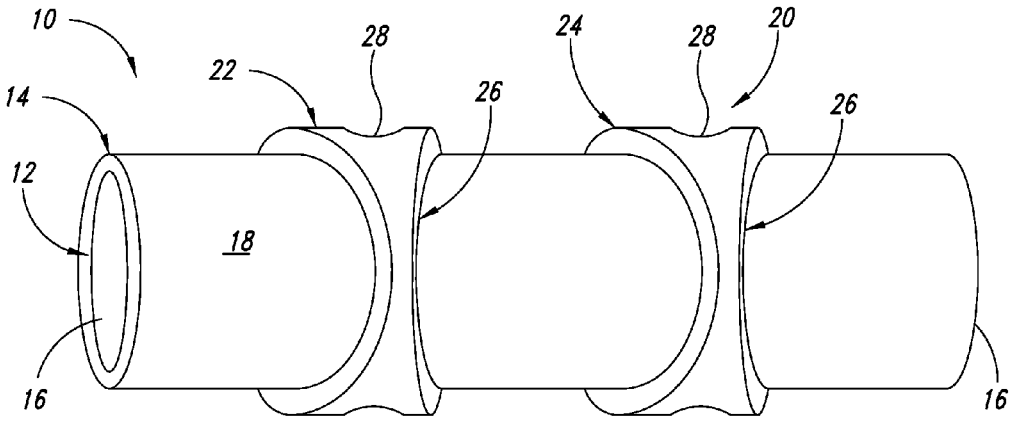
FIG. 1 is an isometric view of a deep tissue massage device formed in accordance with the present disclosure that includes a portion of a pattern of ridges formed on an exterior surface of the device.
Figure 2:
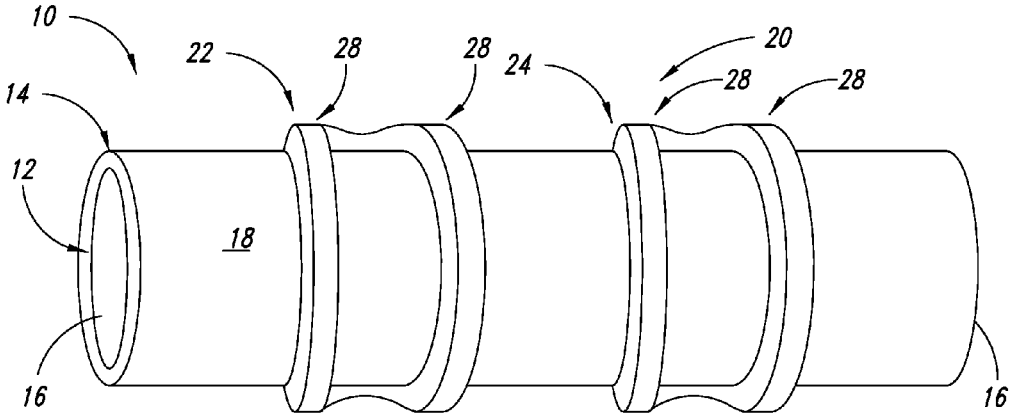
FIG. 2 is further view of the device of FIG. 1 in which the device is rotated to show another portion of the pattern of ridges encircling the exterior surface of the device.

Referring initially to FIGS. 1 and 2, shown therein is a representative embodiment of a deep tissue massage device 10 having a substantially cylindrical shape and consisting of an inner core 12 that is encased by an outer layer 14. The device 10 has truncated ends 16 and a smooth exterior surface 18 on which is formed at least one pattern of ridges 20.

Ideally, the ridge pattern 20 includes a first ridge design 22 and second ridge design 24 in spaced parallel relationship around the circumference of the device. Each ridge design includes a single ridge portion 26, shown more clearly in FIG. 1, joined to a second ridge portion that consists of spaced apart ridges 28 branching from a first end of the single ridge portion and joining back together at a second end of single ridge portion, which is shown more clearly in FIG. 2. Alternatively, the second ridge portion can have one ridge branching from the stem to create diverging ridges at an angle, i.e., the diverging branch or second ridge forms an angle with the stem (now the first ridge), and the second ridge then converges back to the stem (or first ridge) to become a single ridge.

Figure 3:
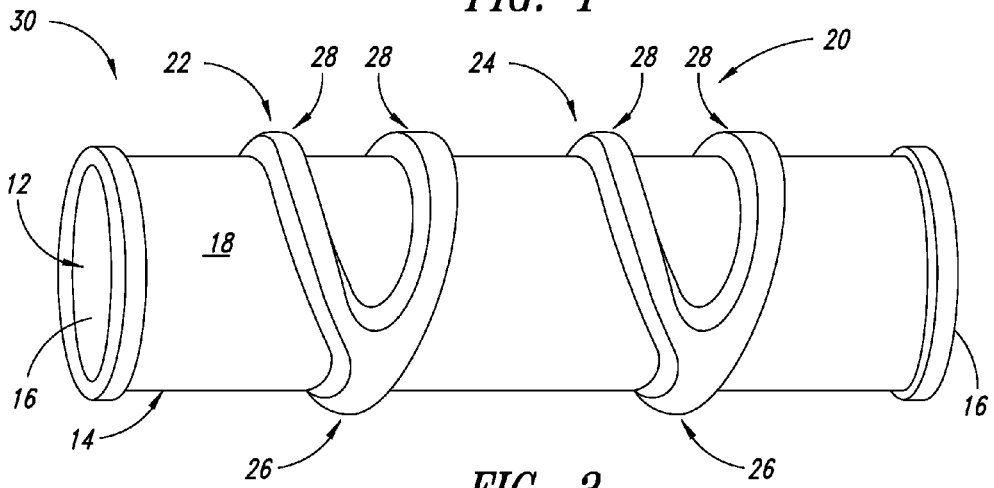
FIG. 3 is an alternative embodiment of the device of FIGS. 1 and 2 formed in accordance with the present disclosure.

FIG. 3 illustrates another embodiment of a deep tissue massage device 30 in which all of the elements in common with the first device 10 are referred to with the same reference numbers. In this second representative embodiment, the device 30 includes an end ridge 32 formed at each truncated end 16. Ideally, the end ridge 32 is a single ridge circumscribing the entire circumference of the device 30 immediately adjacent the truncated end 16. However, other configurations are possible, such as forming the end ridge 32 as part of an end cap or having the ridge formed of arcuate segments, although this is not preferred due to the increased complexity of construction and cost.

Figure 4:
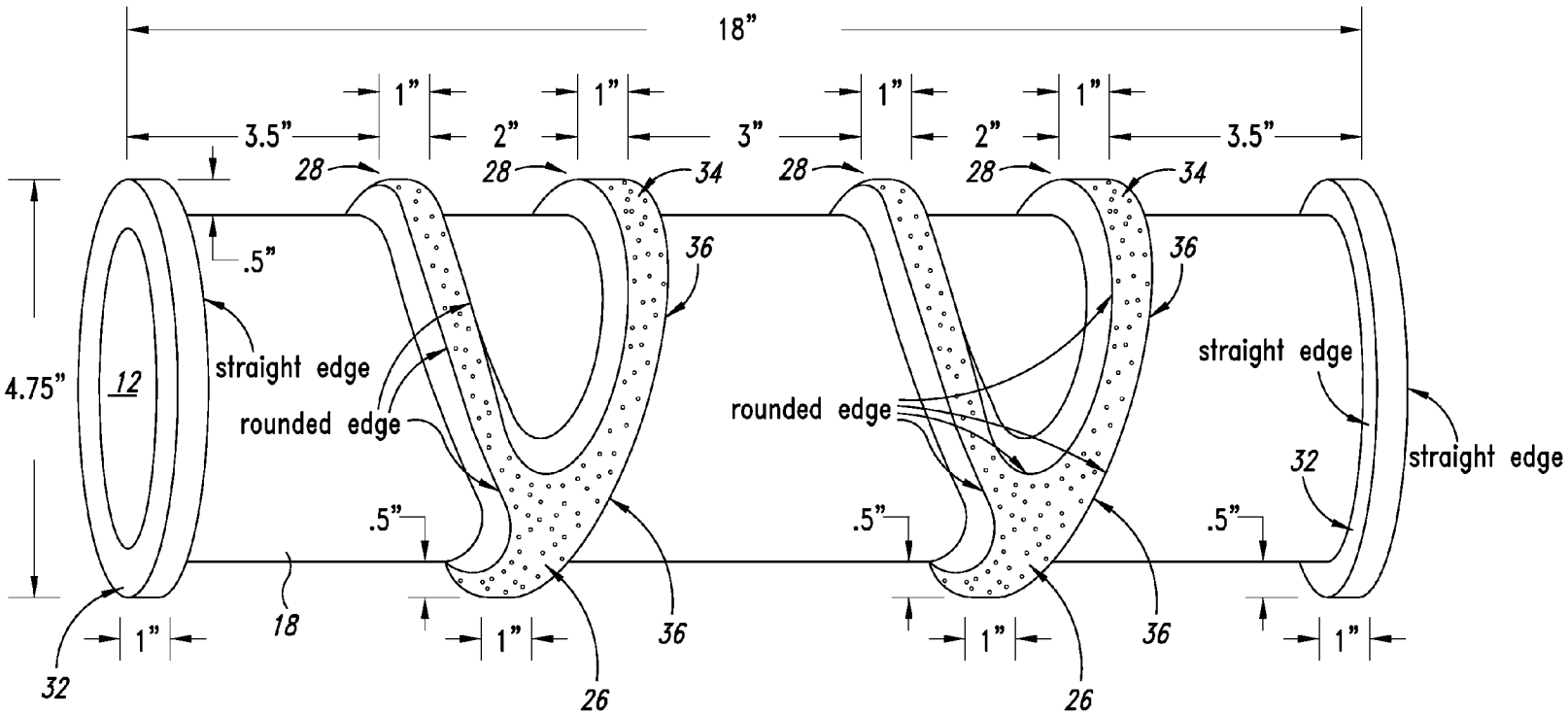
FIG. 4 is an enlarged isometric view of the device of FIG. 3.

FIG. 4 is an enlarged isometric view of the device shown in FIG. 3 in which dimensions and other construction features have been noted thereon. More particularly, the device 30 has a construction that is identical to the device 10, with the exception of the end ridge 32. Thus, with the exception of the end ridges 32, the following discussion will apply to both embodiments of device 10, 30.

Ideally, the device core 12 is formed from Ethylene-vinyl acetate (EVA) foam material at a particularly high density for durability and to resist breaking down over time with use. This high density core 12 is structured to provide a strong support to the outer layer 14, which is wrapped around the core 12 as described more fully below. In addition, the high density EVA foam core is structured to resist compression that is exerted on the outer layer 14 by a user.

The outer layer 14, which contains the ridge pattern 20, is made from an elastomer material that is a combination foam/rubber composition. It is very durable and resistant to breaking down over time. In addition, it is a closed cell material, meaning it has a smooth surface that will not capture bacteria and germs as will an open cell foam (which is used for many other types of foam rollers currently on the market).

It is to be understood that the core 12 and the outer layer 14 may be made from other materials. The core may be made from variations of the EVA foam, derivatives thereof using foam or rubber material, plastics, wood, or combinations thereof. In addition the core could include noncompressible material, such as liquid, or a compressible material such as air. Similarly, the outer layer may be formed from variations or derivatives of the elastomer material, or from foam, rubber material, plastics, wood, or a combination thereof. Alternatively, the outer layer 14 may include the use of liquid or air bladders. In accordance with another aspect of the present disclosure, the entire device 12 may be inflatable.

In construction, the EVA core 12 is made from a standard cylinder mold. The outer layer 14 with the ridge pattern 20 is made by initially creating a mold. Once both components 12, 14 are complete, the outer layer 14 of elastomer is wrapped around the inner EVA core 12 and glued in place using known processes and material that will not be described in detail herein.

Turning next to the ridge pattern 20, the particular shape of the pattern is important because it offers a user two options for deep tissue massage. This is possible because of the linear type design of the ridges formed circumferentially around the exterior surface 18 of the device 30. More particularly, the single ridge portion 26 extends partially around the circumference of the exterior surface 18 to provide a single linear area for a user to roll on to. This provides an aggressive deep tissue massage in a specifically targeted location. In contrast, the dual ridges formed by the spaced apart parallel ridges 28 help a user roll two linear areas of soft tissue at the same time. These dual ridges 28 also provide a stabilizing track on which to roll. This can be beneficial in locating a stable starting point that will enable a user to stay on track to roll onto the single ridge 26. The dual ridges 28 also extend at least partially around the circumference of the exterior surface 18.

In the preferred embodiments shown in FIGS. 1-4, the ridge pattern 20 is formed completely around the exterior surface 18, meaning 360°. This is accomplished by having the ridge pattern 20 formed of two opposing Y-shaped ridge structures in the first and second designs 22, 24. Each Y-shaped ridge structure 28 includes the single ridge stem 26 that branches into the spaced parallel ridges 28, which continue around the exterior surface to join with the spaced parallel ridges 28 of the other Y-shaped design that then merge into the single ridge stem 26. Thus, the first and second ridge designs 22, 24 are each composed of opposing Y-shaped ridges joined together around the complete exterior circumference of the exterior surface 18 of the device 30. The first ridge design 22 is in spaced parallel relationship to the second ridge design 24 as shown in FIGS. 1-4.

Also shown in FIG. 4 are sample dimensions, which include an overall device width of 18 inches with the end ridges 26 having an overall width of one inch and a height above the exterior surface 18 of one-half inch. Similarly, each of the first and second ridge designs 22, 24 have a one inch width at the base and a one-half inch height. The width of each of the spaced parallel ridges 28 is one-half inch at a crown portion 34 that is formed by beveled sidewalls 36. The beveled, or rounded, sidewalls 36 present a smaller surface area, thus allowing deeper penetration of the ridge into the tissue of the user. The distance between the spaced apart ridges 28 at their greatest point is approximately two inches.

It is to be noted that the end ridges 32 have straight or right-angled sidewalls with respect to the exterior surface 18. However, it is possible to form the end ridges 32 to have beveled or rounded sidewalls if desired. These end ridges 32 are designed and structured to provide stability and prevent the roller from tipping during use. In the embodiment where the end ridges 32 are used, there is preferably a three and one-half inch spacing between an outside edge of the spaced parallel ridges 28 and the interior edge of the end ridge 32.

Although the particular pattern of ridges shown and described above is one representative embodiment, additional opposing Y-shaped patterns can be added to the device 10, 30, or different patterns may be used in addition to or in place of the opposing Y-shaped ridge design. This could include a single ridge band partially or completely circumscribing the exterior surface of the device 10, 30. The ridges may also be formed at angles to the longitudinal axis of the cylinder or in a spiral pattern around the outside of the cylinder, although in the preferred embodiment the ridges are as shown and described above. Alternatively, the ridge may be formed in segments such that the ridge is non-continuous. The spacing of the segments would be at a distance that would still present a substantially smooth facing surface that is applied to the user's body.

Figure 5A:
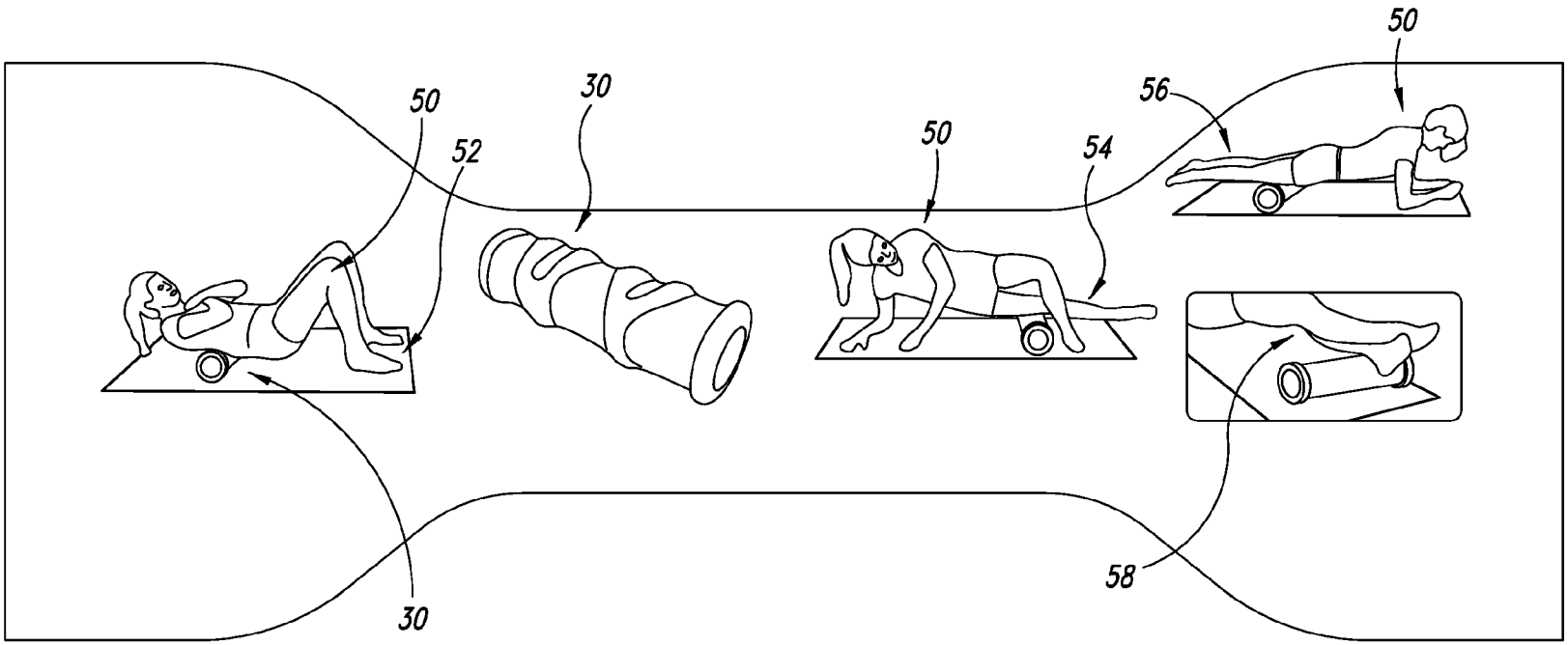
FIGS. 5A-5B illustrate the device of FIG. 4 in use.
Figure 5B:
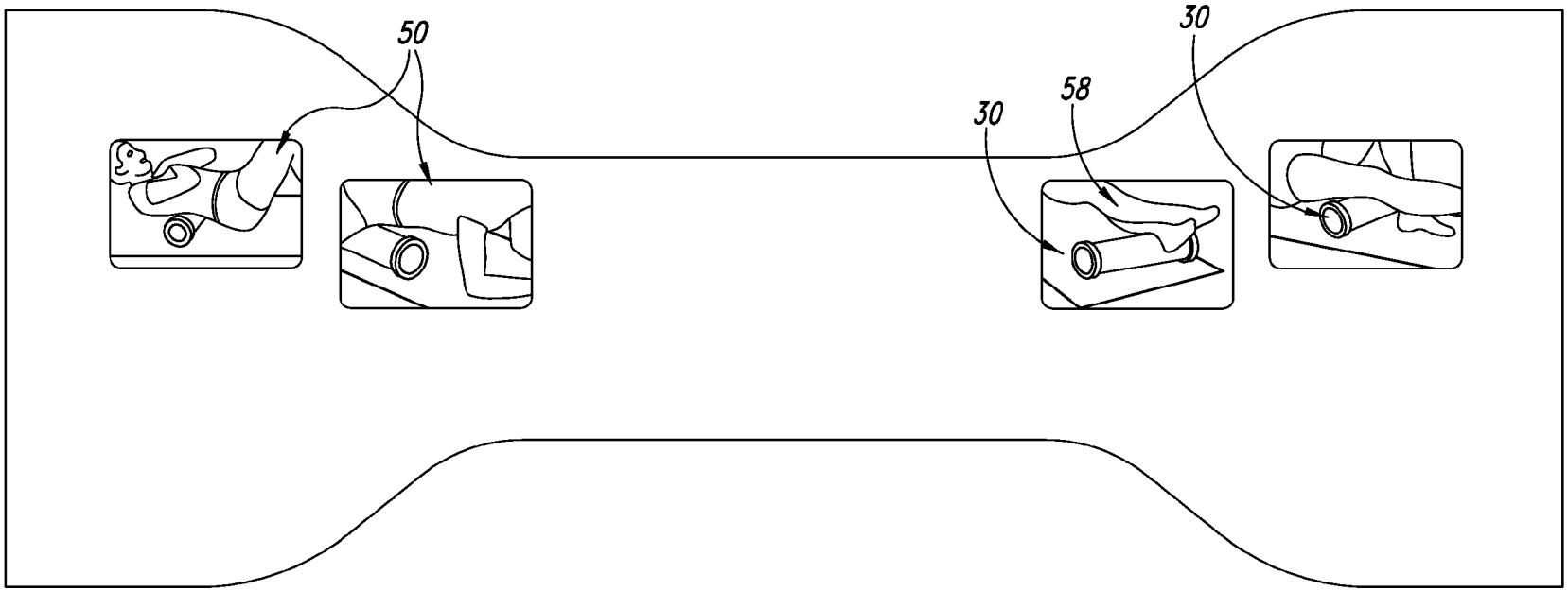

Turning next to FIGS. 5A and 5B, shown therein and described are methods of using the deep tissue device 10, 30 of the present disclosure. Referring initially to FIG. 5A, shown there is a user 50 laying on a support surface 52, such as a mat, with the device 30 positioned under the user's back. Using the legs 56 to provide force, the user 50 keeps their back straight and rolls across the device 30, which in turn urges the device 30 to roll on the mat 52. The user positions their back on the device 30 so that the selected ridge pattern 20 is placed against the tissue the user 50 desires to have massaged.

In the second illustration of FIG. 5A, the user 50 is supporting themselves on the mat 52 with their hands while the right leg 54 of the user is supported on the device 30. Thus, using both hands for balance, the user 50 lies on a side with the roller 30 beneath the hip. The user's IT band is position between the dual ridges 28. The user 50 then slowly rolls onto the single ridge 26, emphasizing an area of tightness on the IT band from the hip to just above the outside of the knee.

In another illustration on FIG. 5A, a user 50 is propped up on their elbows with the upper thighs 56 positioned between the dual ridges 28. The user slowly rolls on to the single ridge 26 emphasizing areas of tightness. Finally, the last illustration in FIG. 5A shows the user's calf 58 supported on the device 30 in which the heel is placed between the dual ridges 28 (crossing the legs at the ankle) The user rolls onto the single ridge 26, slowly rolling up and down the calf to emphasize areas of tightness.

Turning next to FIG. 5B, in the first illustration, the user 50 is shown with the set of dual ridges on either side of the user's spine so that as the user slowly rolls from the lower to the upper back and areas of tightness can be emphasized. The dual ridges used only on either side of the spine avoid direct pressure of the single ridge on the spine.

In the second illustration in FIG. 5B, the user's adductors are massaged by placing the roller underneath the inner area of the upper thigh between the dual ridges. The user slowly rolls onto the single ridge from the upper, inside knee to the inner thigh, shifting weight to increase pressure when necessary.

In the third illustration of FIG. 5B, the user's calf is massaged as described above with respect to FIG. 5A. In the final illustration of FIG. 5B, the user's hamstring is massage by balancing the back of the upper legs on the roller (between the dual ridges) and slowly rolling onto the single ridge. The user rolls the hamstring up and down on the single ridge to emphasize areas of tightness.

When using the foam roller device 10, 30 of the present disclosure for myofascia release, direct pressure on connective tissues (fascia) relaxes muscles and soft tissue, resulting in greater overall flexibility and body wellness.

In order to clean the device 10, 30 a user need only use a sanitizing wipe to remove dirt, bacteria, and germs.

Although a preferred embodiment has been illustrated and described it is to be understood that various changes may be made therein. For example, the length may vary between 12 inches and 36 inches. The diameter may be anywhere in the range of four inches to seven inches with a preferred diameter of four and three-quarter inches. The range of angles of the sidewalls 36 can be varied to provide a different width of the crown 34 on the ridges. In addition, a hand-held version can be constructed to include grips or handles on the truncated ends or extending through the device to enable the user to control the amount of compression through the amount of force they exert with their hands and arms.

It is to be understood that in accordance with another aspect of the present disclosure, the at least one ridge is formed of either a continuous ridge or it may be formed of ridge segments in which spaces are formed between the segments. For example, the Y-shaped ridge does not have to be connected to the opposing Y-shaped ridge but instead can be two discrete Y-shaped ridges. In addition, the ridges can be formed of shorter segments arranged to form a single stem ridge as well as a pair of branched ridges, not necessarily linear and not necessarily in a Y shape, but diverging at an angle from each other or at least one diverging at an angel from the stem to create an angled branch. Although the ridges are shown formed tranverse to the longitudinal axis of the cylinder, they can be parallel to or at other than a right angle to the longitudinal axis of the cylinder.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A deep tissue massage device comprising: a cylinder formed of compressible compliant material and having a longitudinal axis, the cylinder having an external surface with a Y-shaped raised ridge extending radially from the exterior surface of the cylinder, the Y-shaped ridge formed by a continuous raised ridge having a single linear stem with a first end and a second end and a V-shaped branch portion that extends from the second end of the stem, the Y-shaped ridged oriented on the exterior surface of the cylinder with the stem transverse to the longitudinal axis of the cylinder, and wherein the V-shaped branch portion has two linear legs with respective first ends that join together to form an angle to one another and that directly join together with the second end of the stem, and wherein the continuous raised ridge comprises a uniform height extending perpendicularly from the exterior surface.

2. The deep tissue massage device of claim 1, wherein a distance between the two legs at their greatest point of separation is about two inches.

3. The deep tissue massage device of claim 1, comprising first and second end ridges formed on the exterior surface of the cylinder at the first and second ends, respectively, of the cylinder, the end ridges extending radially a distance from the exterior surface of the device that is equal to the distance that the Y-shaped ridge pattern extends from the exterior surface of the cylinder.

4. A device comprising:

a compressible cylinder having a sidewall with a circular cross section configuration defining an outer circumference of the cylinder and a first and second end walls;

a continuous first Y-shaped ridge element formed on the sidewall, the first ridge element including:

a first leg portion having a first end and a second end, the first leg portion having a linear configuration arranged circumferentially around at least a portion of the sidewall, a first arm portion having a first end and a second end, the first end of the first arm portion contiguous with the first end of the first leg portion and having a linear configuration oriented at a first angle to the first leg portion, and a second arm portion having a first end and a second end, the first end of the second arm portion contiguous with the first end of the first leg portion and having a linear configuration oriented at a second angle to the first leg portion that is equal to the first angle; and a continuous second Y-shaped ridge element formed on the sidewall, the second ridge element including:

a second leg portion having a first end and a second end, the second leg portion having a linear configuration arranged circumferentially around at least a portion of the sidewall, the second end of the second leg portion contiguous with and extending from the second end of the first leg portion of the first Y-shaped ridge element, a first arm portion having a first end and a second end, the first end of the of the first arm portion contiguous with the first end of the second leg portion of the second Y-shaped ridge element and having a linear configuration oriented at the first angle to the second leg portion, the second end of the first arm portion contiguous with and extending to the second end of the first arm of the first Y-shaped ridge element, and a second arm portion having a first end and a second end, the first end of the second arm portion contiguous with and extending from the first end of the second leg portion of the second Y-shaped ridge element, the second end of the second arm contiguous with and extending to the second end of the second arm of the first Y-shaped ridge element and having a linear configuration oriented at the second angle to the second leg portion of the second Y-shaped ridge element, and wherein the continuous first Y-shaped ridge element and the continuous second Y-shaped ridge element comprise a uniform height extending perpendicularly from the sidewall.

5. The device of claim 4, wherein the first leg portion of the first Y-shaped ridge element and the second leg portion of the second Y-shaped ridge element are formed on the sidewall at the first end wall and the second end wall, respectively.

6. The device of claim 4, wherein the first Y-shaped ridge element and the second Y-shaped ridge element in combination extend 360° around the outer circumference of the sidewall.

7. The device of claim 4, further comprising:

a first end ridge arranged on the sidewall adjacent to the first end wall; and a second end ridge arranged on the sidewall adjacent to the second end wall, wherein each of the first end ridge and the second end ridge is a linear single ridge extending around the outer circumference of the sidewall.

8. The device as claimed in claim 7, wherein each of the first end ridge and the second end ridge extends radially outward an equal distance from the sidewall.

9. The device as claimed in claim 4, wherein the first Y-shaped ridge element tapers from a one-inch wide base to a one-half inch wide crown, and wherein the first Y-shaped ridge element protrudes one-half inch radially outward from the sidewall.

10. The device as claimed in claim 4, wherein the first arm and the second arm of the first ridge element are no more than two inches apart on the sidewall.

11. The device as claimed in claim 4, wherein the compressible cylinder comprises:

a cylindrical core; and an outer layer wrapped around the cylindrical core, the outer layer comprising the sidewall, the first Y-shaped ridge element, and the second Y-shaped ridge element.

12. A massage device comprising:

a cylinder with an exterior surface and a pair of truncated ends;

a continuous first ridge design formed on the exterior surface, the first ridge design including:

a single ridge portion having a first end and a second end and a linear configuration, and a dual ridge portion having a pair of spaced apart ridges that each have a first end and a second end and a linear configuration and are joined together at their respective first ends, the first ends of the dual ridge portion are joined to the first end of the single ridge portion, and wherein the spaced apart ridges of the dual ridge portion are directly joined together at a second end that in turn is directly joined to the second end of the single ridge portion, the device further comprising: a continuous second ridge design formed circumferentially on the exterior surface of the cylinder, the second ridge design including: a single ridge portion having a first end and a second end, and a dual ridge portion having a pair of spaced apart ridges joined at a first end and at a second end, the first end joined to the first end of the single ridge portion and the second end joined to the second end of the single ridge portion, wherein the first ridge design and the second ridge design are formed in spaced substantially parallel relationship around a circumference of the massage device, and wherein the first ridge design and the second ridge design comprise a uniform height extending perpendicularly from the exterior surface.

13. The device as claimed in claim 12 further comprising:

a pair of end ridges, each end ridge formed adjacent a respective truncated end of the cylinder.

14. The device as claimed in claim 13, wherein each end ridge extends radially from the exterior surface to a distance that is equal to a distance that the first ridge design extends from the exterior surface.

15. The device as claimed in claim 12, wherein the cylinder further comprises:

a core portion formed from Ethylene-vinyl acetate foam material; and an outer layer wrapped around the core portion, the outer layer formed from an elastomer material.

* * * * *